US006126712A

United States Patent [19]

Höhne et al.

[11] Patent Number: 6,126,712

[45] Date of Patent: Oct. 3, 2000

[54] METAL POWDER GRANULATES, METHOD FOR THEIR PRODUCTION AND USE OF THE SAME

[75] Inventors: Matthias Höhne, Sarnia, Canada; Benno Gries, Wolfenbüttel, Germany

[73] Assignee: H. C. Starck GmbH & Co. KG, Goslar, Germany

[21] Appl. No.: 09/077,279

[22] PCT Filed: Nov. 14, 1996

[86] PCT No.: PCT/EP96/04983

§ 371 Date: May 27, 1998

§ 102(e) Date: May 27, 1998

[87] PCT Pub. No.: WO97/19777

PCT Pub. Date: Jun. 5, 1997

[30] Foreign Application Priority Data

Nov. 27, 1995 [EP] European Pat. Off. ..... 195 44 107

[51] Int. Cl.[7] ..... B22F 1/00

[52] U.S. Cl. ..... 75/255; 75/352; 75/354; 75/369; 75/243; 75/246; 75/247

[58] Field of Search ..... 75/352, 354, 369, 75/255, 243, 246, 247

[56] References Cited

U.S. PATENT DOCUMENTS

| | | | |
|---|---|---|---|
| 3,975,217 | 8/1976 | Kunda et al. . | |
| 5,102,452 | 4/1992 | Taskinen et al. | 75/342 |
| 5,185,030 | 2/1993 | Miller et al. | 75/359 |
| 5,482,530 | 1/1996 | Höhne | 75/230 |
| 5,575,830 | 11/1996 | Yamashita et al. | 75/348 |
| 5,662,943 | 9/1997 | Yamashita et al. | 425/3 |
| 5,713,982 | 2/1998 | Clark et al. | 75/359 |
| 5,723,535 | 3/1998 | Krismer et al. | 524/591 |

FOREIGN PATENT DOCUMENTS

| | | | |
|---|---|---|---|
| 0 399 375 | 11/1990 | European Pat. Off. | B22F 1/00 |
| 0 659 508 A3 | 6/1995 | European Pat. Off. | B22F 1/00 |
| PCT/EP96/04983 | 11/1996 | European Pat. Off. | B22F 1/00 |
| 43 43 594 C1 | 2/1995 | Germany | B22F 1/00 |
| 4431 723 C2 | 3/1995 | Germany | C09D 17/00 |

*Primary Examiner*—Ngoclan Mai

*Attorney, Agent, or Firm*—Perkins, Smith&Cohen; Jerry Cohen

[57] ABSTRACT

The invention concerns metal powder granulates comprising one or a plurality of the metals Co, Cu, Ni, W and Mo. The invention further concerns a method for the production of these granulates and the use thereof. The production method is characterized in that a metal compound comprising one or a plurality of the groups comprising oxides, hydroxides, carbonates, hydrogenocarbonates, oxalates, acetates, formiates with binder and optionally in addition between 40 and 80% solvent, relative to the solids content, is granulated as the starting component, and the granulates are thermally reduced in a hydrogen-containing gaseous atmosphere to form the metal powder granulates, the binder and the solvent, if used, being removed completely.

19 Claims, 3 Drawing Sheets

METAL POWDER GRANULATES, METHOD FOR THEIR PRODUCTION AND USE OF THE SAME

BACKGROUND OF THE INVENTION

The present invention relates to a metal powder granulate comprising one or more of the metals Co, Cu, Ni, W and Mo, a process for its preparation and its use.

Granulates of the metals Co, Cu, Ni, W and Mo have many applications as sintered materials. For example copper metal granulates are suitable for preparing copper sliding contacts for motors, tungsten granulates can be used to prepare W/Cu infiltration contacts, Ni and Mo granulates may be used for corresponding semi-finished applications. Cobalt metal powder granulates are used as binder components in composite sintered items, e.g. hard metals and diamond tools.

DE-A 43 43 594 discloses that free-flowing metal powder granulates can be prepared by pulverising and screening out a suitable range of particle sizes. However, these granulates are not suitable for producing diamond tools.

EP-A-399 375 describes the preparation of a free-flowing tungsten carbide/cobalt metal powder granulate. As starting components, the fine powders are agglomerated, together with a binder and a solvent. In a further process step the binder is then removed thermally and the agglomerate is after-treated at 2500° C. in a plasma in order to obtain the desired free-flowing property. Fine cobalt metal powder, however, cannot be granulated using this process because similar processing problems occur at temperatures above the melting point as those encountered during the processing of very fine powders.

DE-A 44 31 723 discloses that pastes of oxide compounds can be obtained if water-dilutable, non-ionogenic rheological additives are added. These additives may be thermally removed, resulting in compact layers on substrates. However, the objective of this process is to coat the substrate with finely divided, completely agglomerate-free particles.

EP-A 0 659 508 describes the preparation of metal powder granulates of the general formula RFeB and RCo, wherein R represents rare-earth metals or compounds, B represents boron and Fe represents iron. Here, an alloy of the components is first prepared and this is reduced to the desired fineness by milling. Then binder and solvent are added and the slurry is dried in a spray drier. The disadvantage of this process, in particular for preparing diamond tools, is that the metals are first alloyed and the fine cobalt powders lose their characteristic properties due to the melting procedure, as described in DE-A 43 43 594. The prior art for producing cobalt metal powder granulates is therefore to add binders or organic solvents to fine cobalt metal powder and to produce corresponding granulates in suitable granulating devices, as can be deduced e.g. from the brochures relating to the granulating machine G10 from the Dr. Fritsch KG Co., Fellbach in Germany and for the solids processor from the PK-Niro Co. in Soeberg, Denmark. The solvents are carefully removed after granulation by an evaporation procedure, but the binder remains in the granulates and has a significant effect on the properties.

The granular particles obtained in this way have a rounded shape. The surface is relatively compact without large pores or openings for the escape of gases. The bulk density determined in accordance with ASTM B 329 is relatively high, 2.0 to 2.4 g/cm$^3$ (Table 2). FIG. 1 shows the scanning electron (SEM) photograph of a commercially available granulate from the Eurotungstene Co., Grenoble, France, and FIG. 2 shows a commercially available granular material from the Hoboken Co., Overpelt, Belgium. Although the rounded shape of the particles and the high bulk densities lead to the desired improved flow properties for cobalt, processing problems are still not inconsiderable in practice.

For example, relatively high compression forces have to applied during cold compression in order to obtain preforms with sufficient strength and edge stability. The reason for this is that the production of firmly interlocking compounds, i.e. expressed more simply, the hooking together of the individual particles, which is important for providing strength in the preforms, is difficult with spherical or rounded particles. At the same time, a dense, closed structure leads to an increase in the resistance to deformation. Both factors lead to an increase in the compression forces required during cold compression. This can in practice, however, cause increasing wear on the cold compression moulds, i.e. to lower durability of the cold compression moulds, which again leads to increased production costs.

Quantitatively, the compression behaviour can be described by measuring the compaction factor $F_{comp}$. $F_{comp}$ is defined by the equation:

$$F_{comp}=(\rho_p-\rho_o)/\rho_p$$

where $\rho_o$ is the bulk density in g/cm$^3$ of the cobalt metal powder granulate in the original state and $\rho_p$ is the density in g/cm$^3$ after compression.

The most serious disadvantage, however, is that the binder used during preparation of the granulates remains in the granulates (see Table 1).

In the following a binder is understood to mean a film-forming substance which is optionally dissolved in a solvent and added to the starting components in a suitable granulating process so that the powder surface is wetted and, optionally after removing the solvent, holds this together by forming a surface film on the primary particles. Granulates with sufficient mechanical strength are produced in this way. Alternatively, substances which use capillary forces to provide mechanical strength in the granulate particles may also be considered as binders.

TABLE 1

Typical concentrations of carbon from the binder in commercially available cobalt metal powder granulates.

| | EUROTUNGSTENE Grenoble, France | HOBOKEN Overpelt, Belgium | HOBOKEN Overpelt, Belgium |
|---|---|---|---|
| Product | Co ultrafine granulated | Co extrafine soft granulate | Co extrafine hard granulate |
| Carbon content | ca. 1.5% | ca. 0.98% | ca. 0.96% |

If items are prepared from these cobalt metal powder granulates, for example using the hot compression technique which is most frequently applied, then the heating time must be extended in order to remove the organic binder completely. This may result in a production loss of up to 25%. If, on the other hand, the heating times are not extended, then carbon clusters are observed in the hot compressed segments, these resulting from cracking of the binder. This frequently leads to an obvious impairment in the quality of tools.

A further disadvantage is the use of organic solvents which have to be carefully removed by evaporation after granulation. Firstly, removing the solvent by a thermal process is cost intensive. In addition the use of organic solvents incurs substantial disadvantages with respect to environmental impact, plant safety and the energy balance. The use of organic solvents frequently requires a considerable amount of equipment such as gas extraction and waste treatment devices as well as filters in order to prevent the emission of organic solvents during granulation. A further disadvantage is that the plants have to be protected against explosions, which again increases the production costs.

The disadvantages of working with organic solvents can in theory be avoided by dissolving the binder in water. However, the fine cobalt metal powders are then partially oxidised and therefore cannot be used.

Now, the object of this invention is to provide a metal powder granulate which does not have the disadvantages of the powders described above.

SUMMARY OF THE INVENTION

According to the invention a metal compound selected from the group consisting of metal oxide, hydroxides, carbonate, hydrogen carbonate, oxalates, acetates and formates and a binder are granulated (or the compound is granulated in the presence of a binder). Solvent is optionally provided too, in the binder-granulated compound mixture in an amount of 40–80 wt. % with respect to solids content. Then the compound is thermally and/or chemically reduced to free the metal within the mixture. The metal is separated from the mixture and is in a powder form with up to 10 wt. % of −50 micron material (measured by American Society for Testing Materials, ASTM, standard B214), but no more, and overall carbon content less than 0.1 wt. %. The metals that can be so prepared include Co, Cu, Ni, W and Mo.

DETAILED DESCRIPTION OF PREFERRED EMBODIMENTS

Figure 1:
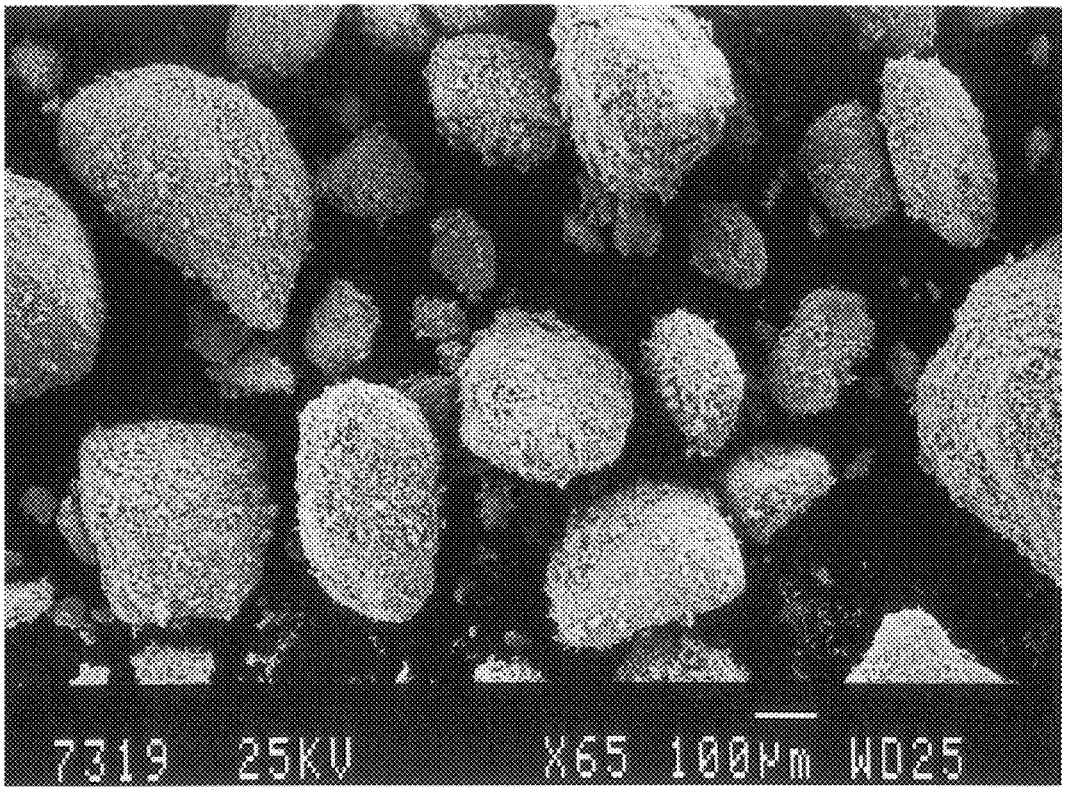
FIGS. 1–3 are scanning electron micrographs (at 65× nagriificltion, see the 100 $\mu$m fiduciary marks in each.
Figure 2:
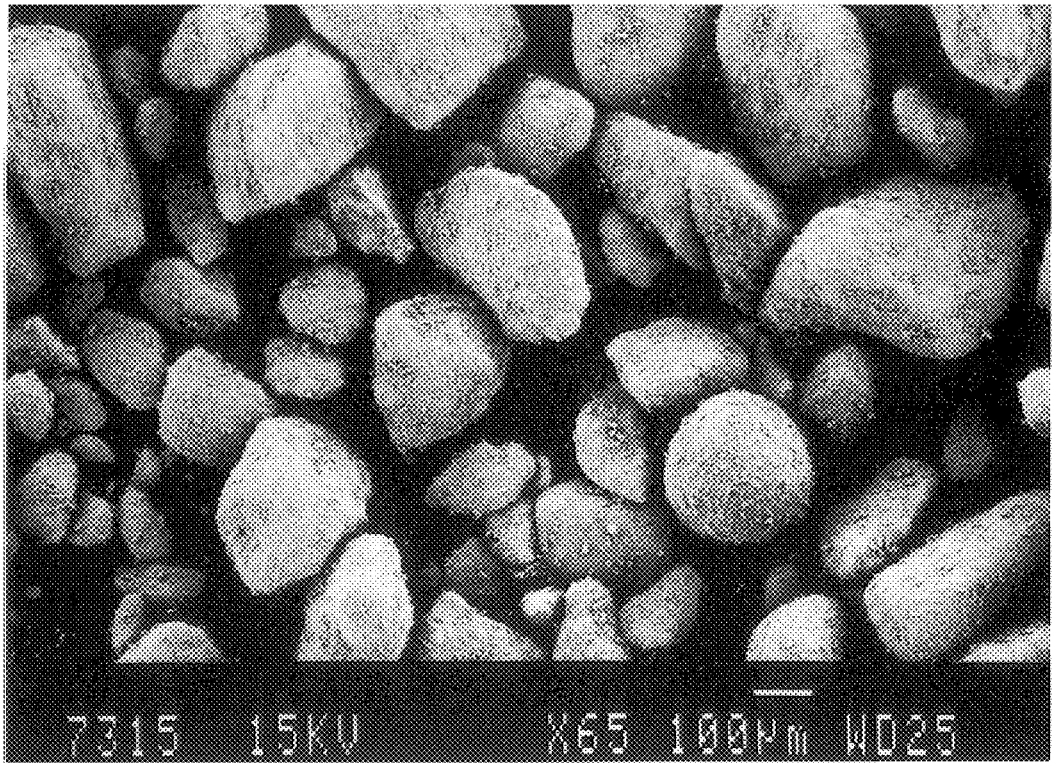
Figure 3:
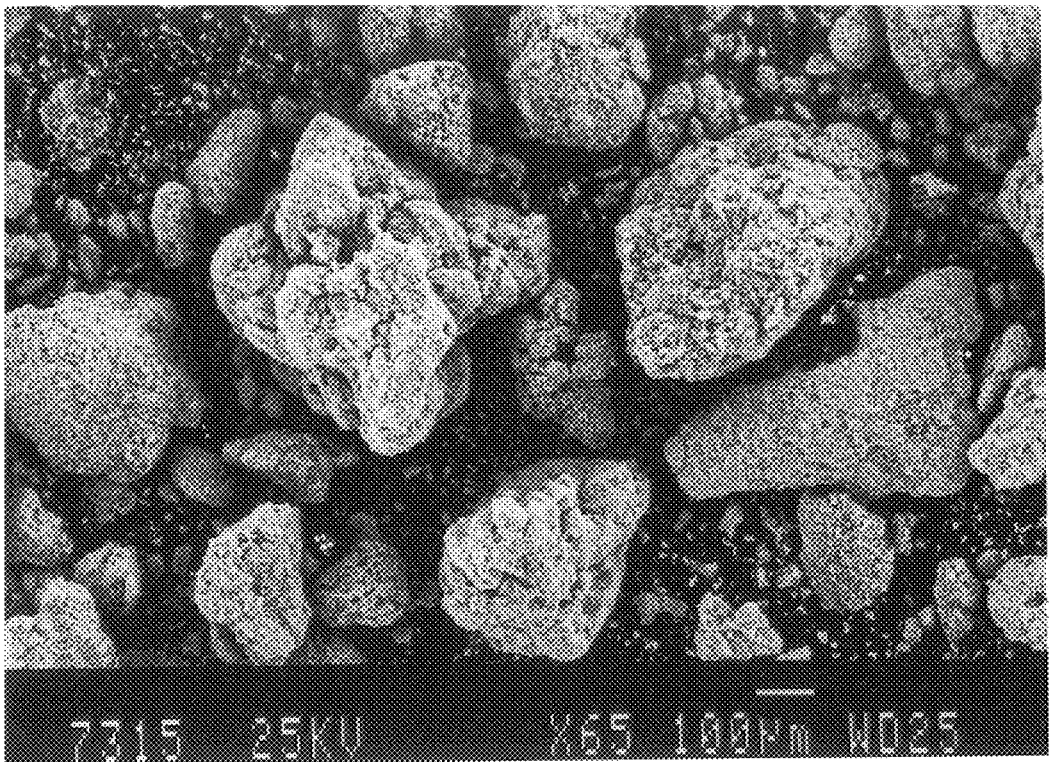

A binder-free metal powder granulate which comprises one or more of the metals Co, Cu, Ni, W and Mo has been successfully prepared, wherein a maximum of 10 wt. % is less than 50 $\mu$m in accordance with ASTM B214 and the total carbon content is less than 0.1 wt. %, in particular less than 400 ppm. This binder-free metal powder granulate is the subject of this invention. Furthermore the surface and particle shape are substantially optimised in the product according to the invention. FIG. 3 shows the SEM photograph of the metal powder granulate in accordance with the invention using a cobalt metal powder granulate according to the invention as an example. It has a cracked, fissured structure which facilitates the production of interlocking compounds. Furthermore, it is obvious from the SEM photograph that the granulate according to the invention is very porous. This considerably reduces the resistance to deformation during cold compression. The porous structure is also reflected in the bulk density. The cobalt metal powder granulate preferably has a low bulk density, between 0.5 and 1.5 g/cm$^3$, determined in accordance with ASTM B329. In a particularly preferred embodiment, it has a compaction factor $F_{comp}$ of at least 60% and at most 80%. This high compaction factor leads to outstanding compressibility. Thus, for example, cold compressed sintered items which have outstanding mechanical edge stability can be prepared at a pressure of 667 kg/cm$^2$.

In Table 2 given below, the bulk densities of the product according to the invention in the original condition ($\rho_o$) the density after compression ($\rho_p$) and the compaction factor $F_{comp}$ are listed and compared with commercially available granulates.

TABLE 2

Typical bulk densities in the original condition ($\rho_o$) and after compression at 667 kg/cm$^2$ ($\rho_p$) and the compaction factor of the cobalt metal powdered granulate according to the invention compared with commercially available products.

| Manufacturer | HCST Goslar, Germany | Euro-tungstene Grenoble, France | Hoboken Overpelt, Belgium | Hoboken Overpelt, Belgium |
|---|---|---|---|---|
| Product | Co metal powder granulate according to the invention | Co metal powder granulate, ultrafine | Co metal powder granulate, extrafine soft granulated | Co metal powder granulate, extrafine hard granulated |
| Bulk density ($\rho_o$) (g/cm$^3$) | 1.03 | 2.13 | 2.4 | 2.4 |
| Compressed density ($\rho_p$) (g/cm$^3$) | 3.45 | 4.31 | 4.69 | 4.79 |
| Compaction factor $F_{comp}$ (%) | 70.1 | 50.6 | 48.8 | 49.8 |
| Assessment of moulded item | stable, no broken edges | reduced edge stability | greatly reduced edge stability | low edge stability |

The preforms were prepared in a uniaxial hydraulic press with a 2.5 t load and a square moulding plug area of 2.25 cm$^2$, using 6 g of material.

This invention also provides a process for preparing metal powder granulates according to the invention. This is a process for preparing binder-free metal powder granulates containing one or more of the metals Co, Cu, Ni, W and Mo, wherein, as starting component, a metal compound consisting of one or more of the group of metal oxides, hydroxides, carbonates, hydrogen carbonates, oxalates, acetates and formates is granulated with binder and optionally also with 40% to 80% of solvent, with respect to the solids content, and the granulate is thermally reduced to the metal powder granulate by placing it in a hydrogen-containing gaseous atmosphere, wherein the binder and optionally the solvent are removed and leave no residues. If one or more of the metal compounds mentioned are selected, then no oxidation of the fine cobalt metal powder occurs during the granulation process if aqueous solutions are used. The process according to the invention therefore offers the possibility of using solvents which consist of organic compounds and/or water, wherein it is particularly preferred, but not in a restrictive manner, that water be used as solvent. The added binders are used either without solvent or dissolved or suspended or emulsified in a solvent. The binders and solvents may be inorganic or organic compounds which are built up from one or more of the elements carbon. hydrogen, oxygen, nitrogen and sulfur and contain no halogen and also contain no metals, other than traces which are the unavoidable consequence of their method of preparation.

Furthermore, the binders and solvents selected can be removed at temperatures of less than 650° C. and leave no residues. One or more of the following compounds are particularly suitable as binders: paraffin oils, paraffin waxes, polyvinyl acetates. polyvinyl alcohols, polyacrylamides, methyl celluloses, glycerol, polyethylene glycols, linseed oils, polyvinylpyridine.

The use of polyvinyl alcohol as binder and water as solvent is particularly preferred. Granulation of the starting components is achieved in accordance with the invention by performing granulation as a plate, building-up, spray drying, fluidised bed or compression granulation procedure or granulation is performed in high speed mixers.

The process according to the invention is performed in particular in an annular mixer-granulator, continuously or batchwise.

These granulates are then reduced, preferably in a hydrogen-containing gaseous atmosphere at temperatures of 400 to 1100° C., in particular 400 to 650° C., to form the metal powder granulate. The binder and optionally the solvent are then removed and leave no residues. Another specific variant of the process according to the invention comprises first drying the granulate at temperatures of 50 to 400° C. after the granulation step and then reducing at temperatures of 400 to 1100° C. in a hydrogen-containing atmosphere to form the metal powder granulate.

Metal powder granulates according to the invention are particularly suitable for the preparation of sintered and composite sintered items. This invention therefore also provides the use of metal powder granulates according to the invention as binder components in sintered items or composite sintered items prepared from powders of hard materials and/or diamond powder and binders.

In the following the invention is illustrated by way of example without this being regarded as a restriction.

EXAMPLE 1

5 kg of cobalt oxide and 25 wt. % of a 10% strength aqueous methyl cellulose solution were placed in an RV 02 intensive mixer from Eirich Co. and granulated for 8 minutes at 1500 rpm. The granulate produced was reduced at 600° C. under hydrogen. After screening out particles larger than I mm, a cobalt metal powder granulate with the values listed in Table 3 was obtained.

EXAMPLE 2

100 kg of cobalt oxide was mixed with 70 wt. % of a 3% strength polyvinyl alcohol solution in a kneader from AMK Co. The rod-shaped extrudate produced in this way was converted directly to cobalt metal powder granulate in a rotating tube at 700° C. and then particles larger than 1 mm were sieved out. A cobalt metal powder granulate with the values listed in Table 3 was obtained.

EXAMPLE 3

2 kg of cobalt carbonate were granulated with 70% of a 1% strength aqueous polyethylene glycol mixture at 160 rpm in a 5 1 laboratory mixture from Lödige Co. The initially produced granulate was reduced at 600° C. under hydrogen in a pushed-batt kiln. A cobalt metal powder granulate with the values listed in Table 3 was obtained.

EXAMPLE 4

60 kg of cobalt oxide were granulated with 54 wt. % of a 10% strength polyvinyl alcohol solution in an RMG 10 annular mixer-granulator from Ruberg Co. using the maximum speed of the granulator, and the granulate formed in this way was reduced at 55° C. under hydrogen in a stationary bed to give a cobalt metal powder granulate. A cobalt metal powder granulate with the values listed in Table 3 was obtained after screening.

The compaction factor $F_{comp}$ of 70.1% was determined using a uniaxial, hydraulic press with a 2.5 t load and a moulding plug area of 2.25 $m^2$, and with 6 g of material.

TABLE 3

Properties of the cobalt-containing granulates described in the examples.

| Example | Total carbon content (ppm) | Bulk density ($g/cm^3$) | Sieve analysis according to ASTM B 214 (%) +1000 μm | −1000 μm +50 μm | −50 μm |
|---|---|---|---|---|---|
| 1 | 200 | 1.4 | 3.4 | 90.5 | 6.1 |
| 2 | 360 | 1.2 | 6.9 | 91.0 | 2.1 |
| 3 | 310 | 0.8 | 4.5 | 89.9 | 5.6 |
| 4 | 80 | 1.0 | 0.2 | 96.1 | 3.7 |

What is claimed is:

1. Powder granulate of a metal selected from the group consisting of Co, Cu, Ni, W and Mo, the metal powder granulate having a maximum of 10 wt. % of the fraction −50 μm in accordance with ASTM B214 and total carbon content less than 0.1 wt. %.

2. Metal powder granulate according to claim 1, wherein the total carbon content is less than 400 ppm.

3. Metal powder granulate according to one of claims 1 or 2, wherein the granulate has a porous, cracked, fissured structure.

4. Cobalt metal powder granulate according to either of claims 1 or 2, wherein it has a bulk density, according to ASTM B329, in the range 0.5 to 1.5 $g/cm^3$.

5. Cobalt metal powder granulate according to either of claims 1 or 2, wherein it has a compaction factor $F_{comp}$ of at least 60% and at most 80%.

6. Process for preparing a metal powder granulate in accordance with either of claims 1 or 2, comprising granulating a metal compound the selected from the group consisting of oxides, hydroxides, carbonates, hydrogen carbonates, oxalates, acetates, formates with binder and optionally also with 40% to 80% of solvent, with respect to the solids content, and thermally reducing the granulates to the metal powder granulate in a hydrogen-containing gaseous atmosphere, wherein the binder, and optionally the solvent, is removed and leaves no residue.

7. Process according to claim 6, wherein organic or inorganic compounds comprising one or more of the elements carbon, hydrogen, oxygen, nitrogen and sulfur and are free of halogens and metals are used as binder and optionally solvent.

8. Process according to either of claims 6 or 7, wherein the binder and optionally solvent can be removed thermally at temperatures of less than 650° C. to leave no residues.

9. Process according to either of claims 6 or 7, wherein the granulation is achieved by a process selected in the groups consisting of building-up granulation, spray dryer granulation, fluidised bed granulation, plate granulation, compression granulation and granulation in high speed mixers.

10. Process according to claim 9, wherein granulation is performed in high speed mixers as annular mixing-granulation.

11. Process according to one or more of claims 6 or 7, wherein the granulates are reduced to the metal powder granulates in a hydrogen-containing gaseous atmosphere at temperatures of 400 to 1100° C.

12. Process according to either of claims 6 or 7, wherein the granulates are first thermally dried at temperatures of 50 to 400° C. and that the granulates are then reduced to the metal powder granulate in a hydrogen-containing gaseous atmosphere at temperatures of 400 to 1100° C.

13. Cobalt metal powder granulate according to claim 4 wherein it has a bulk density, per ASTM B229, in the range of 1.0 to 1.2 g/cm$^3$.

14. Process according to claim 11 wherein the reducing atmosphere is provided at 400 to 650° C.

15. A sintered powder compact made of sintered together metal powder of either of claims 1 or 2, alone or with diamond.

16. A sintered diamond compact with a binder containing metal powder of either of claims 1 or 2.

17. Cobalt powder granulate with a maximum of 10 wt. % of −50 $\mu$m fraction. per ASTM B214, total carbon content under 400 ppm, a porous, cracked, fissure structure, bulk density, per ASTM B229, of 1.0 to 1.2 g/cm$^3$ and a compaction factor Fcomp of 60% to 80%.

18. A sintered powder compact made of sintered together metal powder of claim 17, alone or with diamond.

19. A sintered diamond compact with a binder containing metal powder of claim 17.

* * * * *